United States Patent [19]

Pezzoli

[11] Patent Number: 4,648,429

[45] Date of Patent: Mar. 10, 1987

[54] WEFT CARRYING GRIPPERS FOR SHUTTLELESS WEAVING LOOMS

[75] Inventor: Luigi Pezzoli, Leffe, Italy

[73] Assignee: Vamatex S.p.A., Villa Di Serio, Italy

[21] Appl. No.: 740,034

[22] Filed: May 31, 1985

[30] Foreign Application Priority Data

Jun. 7, 1984 [IT] Italy ..... 21291 A/84

[51] Int. Cl.[4] ..... D03D 47/20

[52] U.S. Cl. ..... 139/448

[58] Field of Search ..... 139/447, 448

[56] References Cited

U.S. PATENT DOCUMENTS 3,532,136 10/1970 Golobart ..... 139/448

4,357,964 11/1982 Kohler ..... 139/448

FOREIGN PATENT DOCUMENTS 131386 6/1978 German Democratic Rep. ..... 139/448

*Primary Examiner*—Henry S. Jaudon

*Attorney, Agent, or Firm*—Young & Thompson

[57] ABSTRACT

A pair of weft carrying grippers, of the type wherein the weft yarn is retained by engagement of the head of a slider moving lengthwise, with a counteracting cooperating surface of the gripper body, the slider being thrust forward by a spring and being released by pulling a flexible lamina element connected thereto. In this pair of grippers, the flexible lamina element causing the release of the slider is controlled by a rotary cam having a slightly curved contour, around which the element may wind smoothly. Moreover, the slider head is shaped like a helical wedge, adapted to mate with an equally shaped counteracting surface of the gripper body, or it may carry at least one spring lamina, adapted to engage with a substantially flat counteracting surface of the gripper body.

1 Claim, 8 Drawing Figures

WEFT CARRYING GRIPPERS FOR SHUTTLELESS WEAVING LOOMS

BACKGROUND OF THE INVENTION

The present invention concerns important improvements in the weft carrying grippers for shuttleless weaving looms, namely in those members by which the weft yarns are inserted at one end of the loom and are carried to the opposite end thereof through the warp shed.

There are known to be a great number of members of this kind. The invention particularly concerns a pair of weft carrying grippers, of the type wherein the weft yarn is retained by engagement of the head of a slider moving lengthwise, with a counteracting cooperating surface of the gripper body, said slider being thrust forward by a spring and being released by pulling a flexible lamina element connected thereto.

To date, in these grippers, the flexible lamina element causing the release of the slider (and thus the freeing of the weft yarn or of the seat engaging said yarn) is wound round a cylindrical pin, to allow the slider to move. Considering the somewhat limited dimensions involved, it has been found that the flexible control element, deeply stressed at high frequency, was inclined to break through fatigue after a period of use of the grippers which was too short to satisfy the production requirements. Moreover, in the known grippers of this type, difficulties to insert and retain the weft yarn were met when changing over from the medium counts of more common yarns to the thicker or thinner counts and/or to special types of yarns.

The present invention proposes to prevent these drawbacks by improving, on one hand, the mechanics of the slider return means for engagement of the weft yarn and, on the other hand, the construction of the head of said slider.

SUMMARY OF THE INVENTION

For this purpose, the present invention supplies a pair of grippers—a carrying gripper and, respectively, a drawing gripper—of the type heretofore specified, characterized in that, in each gripper, the flexible lamina element causing the release of the slider, is controlled by a rotary cam having a slightly curved contour, around which said element may wind smoothly.

Moreover, in this pair of grippers, the slider head of each gripper is shaped like a helical wedge, adapted to mate with a counteracting surface of equal shape of the gripper body, or else it carries at least one spring lamina, adapted to engage with a substantially flat counteracting surface of the gripper body.

BRIEF DESCRIPTION OF THE DRAWINGS

The invention will now be described in further detail, by mere way of example, with reference to the accompanying drawings, in which:

FIG. 1 is a general perspective view, showing a carrying gripper according to the invention, of which

FIG. 5 is a general perspective view, showing a drawing gripper according to the invention, of which

DESCRIPTION OF THE PREFERRED EMBODIMENTS

Figure 1:
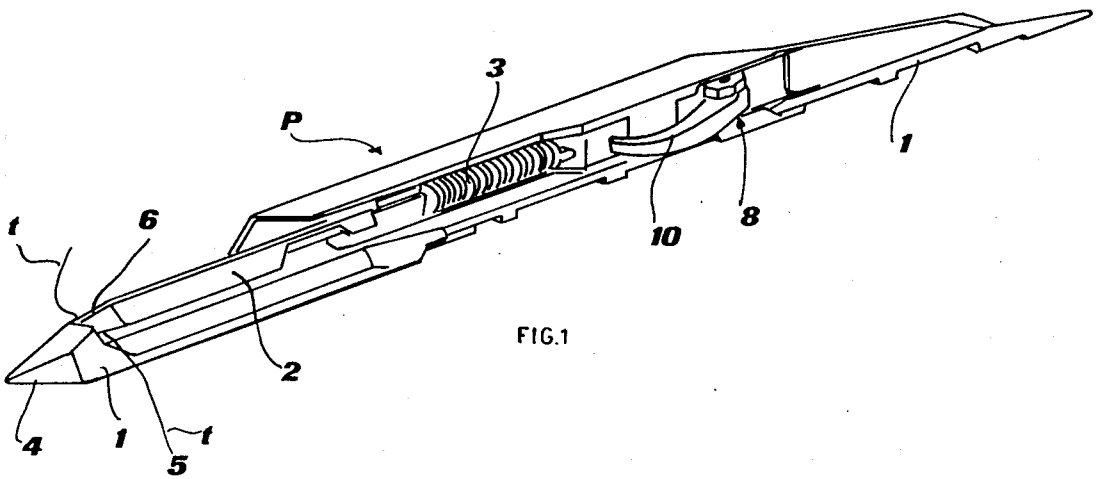
Figure 2:
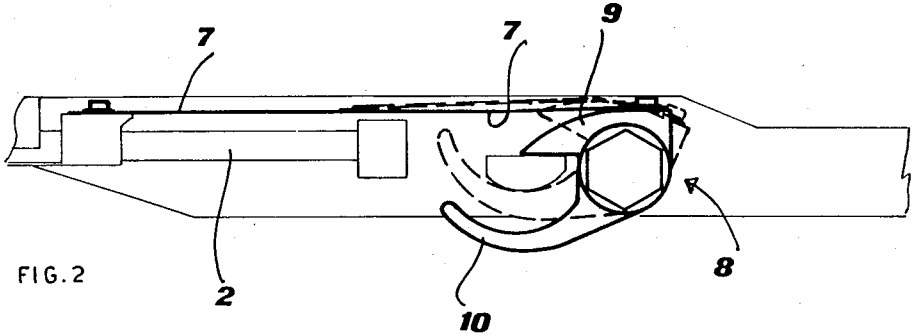
FIG. 2 shows the detail of the means controlling the flexible element which releases the slider.
Figure 5:
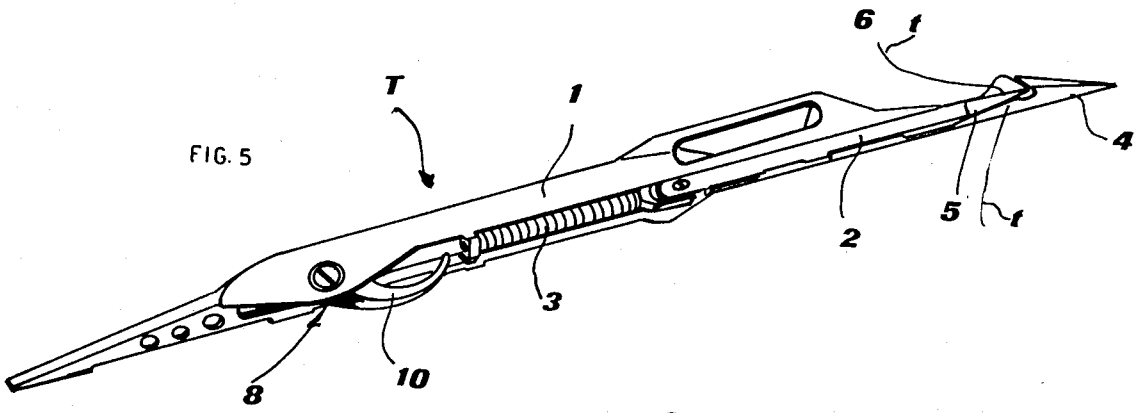
Figure 6:
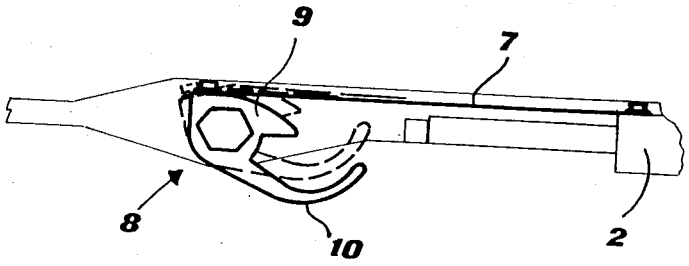
FIG. 6 shows the detail of the means controlling the flexible element which releases the slider.

The pair of weft carrying grippers according to the invention comprises the carrying gripper P of FIG. 1 and the drawing gripper T of FIG. 5. Both these grippers have a known type structure consisting of a body 1 of highly stiff synthetic plastic material, into which is mounted a metal slider 2, moving lengthwise and thrust forward by a spring 3 towards the tip 4 of the body 1, so as to engage with its head 5 a counteracting surface 6 of said body and lock therebetween the weft yarn t. Also in known manner, the slider 2 is released from the surface 6, against the action of the spring 3, by a flexible element 7 (FIGS. 2 and 6) consisting of a lamina of synthetic material, which is fixed with one end to the slider 2 and with the other end to a rotary control member 8, around which it partially winds.

According to the invention, the control member 8 consists—in both grippers P and T—of a cam 9 having a smoothly curved contour, onto the end of which the lamina 7 is fixed, said cam rotating under the control of a bent control lever 10. As is evident from FIG. 2, the radius of curvature of the cam surface of cam 9 is substantially greater than the distance from that cam surface to the axis of rotation of cam 9. The lamina 7, normally contacting the cam 9 only close to its end (continuous lines in FIGS. 2 and 6), is apt to wind very smoothly around the contour of said cam, when this latter is caused to rotate (dashed lines in the same figures) thanks to the action imparted on the control lever 10 by the loom releasing member (not shown).

It can be easily understood that, thanks to the smoothly curved contour of the cam 9, the stresses which the lamina 7 has to stand each time it is pulled to control the movements of the slider 2, are very limited. Hence, even if such stresses are repeated at a very high frequency, they cause no breakages in said lamina for very long periods of use.

Figure 7:
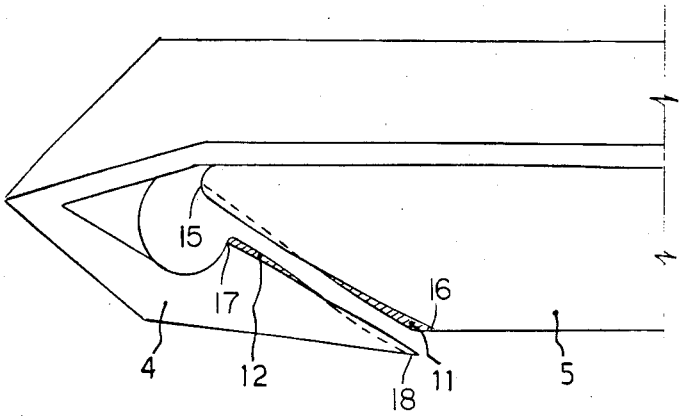
FIGS. 7 and 8 show the detail of two alternative embodiments of the slider head and of the counteracting gripper body surface.
Figure 3:
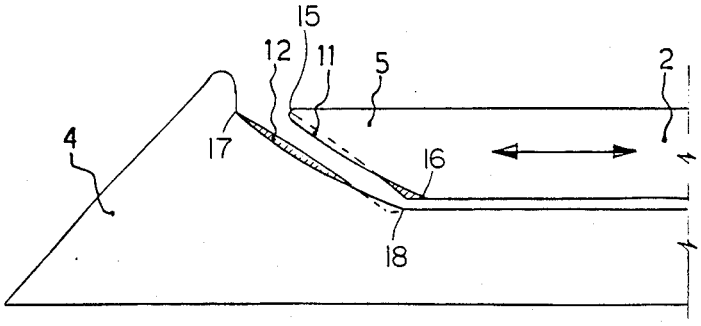
FIGS. 3 and 4 show the detail of two alternative embodiments of the slider head and of the counteracting gripper body surface.

Also according to the invention, the head 5 of the slider 2 is constructed in the form of a helical wedge 11 (FIGS. 3 and 7), adapted to mate with an equally shaped counteracting surface 12 on tip 4 of the gripper body 1.

As can be seen from these figures, the head 5 has a forward end constituted by wedge 11, which extends from an upper forward edge 15 to a lower rear edge 16, whereby wedge 11 faces forwardly and downwardly and is inclined toward one lateral side adjacent edge 15 and toward the other lateral side adjacent edge 16. Similarly, surface 12 on tip 4 extends from an upper forward edge 17 to a lower rear edge 18, whereby surface 12 faces rearwardly and upwardly and is inclined, adjacent edges 17 and 18, toward the same lateral sides as wedge 11 adjacent edges 15 and 16, respectively.

This guarantees a particularly efficient weft yarn insertion and engagement for any type and count of yarn.

Figure 8:
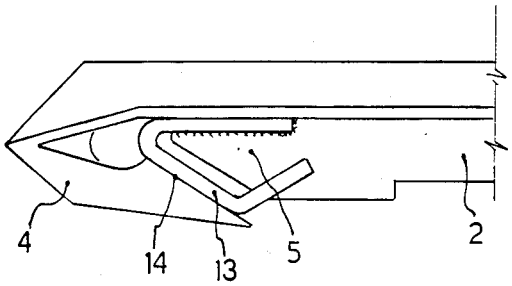
Figure 4:
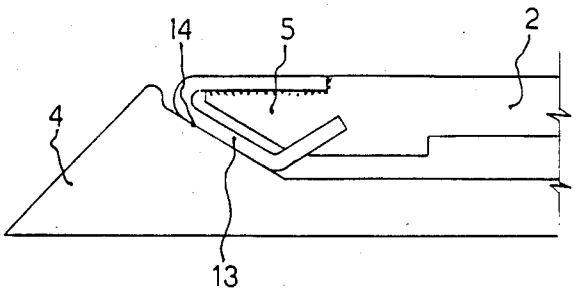

Similar results are obtained by providing the head 5 of the slider 2 with spring laminae, adapted to engage with a flat counteracting surface of the gripper body. A preferred embodiment of this solution is shown in FIGS. 4 and 8, wherein use is made of V-shaped laminae 13, having one branch fixed to the head 5 of the slider 2 and the other branch free and bent at the end, and of flat counteracting surfaces 14 of the gripper body.

It is to be understood that, besides those already described and illustrated by way of example, there may be other embodiments of the invention falling within the protection scope of the same.

I claim:

1. A weft carrying gripper of the type wherein the weft yarn is retained by engagement of head of a slider moving lengthwise, with a counteracting cooperating surface of the gripper body, said slider being thrust forward by a spring and being released by pulling a flexible lamina element connected thereto; the improvement in which the slider head of the gripper is shaped like a helical wedge, adapted to mate with an equally shaped counteracting surface of the gripper body, said wedge having an upper forward edge and a lower rear edge and facing forwardly and downwardly and being inclined toward one lateral side adjacent one of said edges and toward the other lateral side adjacent the other of said edges, said counteracting surface extending from an upper forward edge to a lower rear edge and facing rearwardly and upwardly and being inclined, adjacent its said edges, toward the same lateral sides as said wedge adjacent the respective said edges of said wedge.

* * * * *